US006167930B1

(12) United States Patent
Harper et al.

(10) Patent No.: US 6,167,930 B1
(45) Date of Patent: Jan. 2, 2001

(54) SEGMENTED VARIABLE HEIGHT BASKET BODY FORM

(75) Inventors: Tom Harper; Duane Bice, both of Nashport; Jack Hindel, Frazeysburg; Tim Teal, Mount Vernon; Leane Lefever, Frazeysburg; Vicki Lahna, Coshocton; Todd Miller, Nashport; Chris Corp, Coshocton, all of OH (US)

(73) Assignee: The Longaberger Company, Newark, OH (US)

( * ) Notice: Under 35 U.S.C. 154(b), the term of this patent shall be extended for 0 days.

(21) Appl. No.: 09/365,367

(22) Filed: Jul. 30, 1999

Related U.S. Application Data

(60) Provisional application No. 60/094,981, filed on Jul. 31, 1998.

(51) Int. Cl.[7] ..... B27J 1/00
(52) U.S. Cl. ..... 147/48
(58) Field of Search ..... 147/48; 217/122, 217/123; 29/463

(56) References Cited

U.S. PATENT DOCUMENTS 1,724,293 * 8/1929 Lawrence ..... 147/48
2,609,958 * 9/1952 Mzik ..... 147/48
4,678,016 * 7/1987 Hall ..... 147/48
4,832,097 * 5/1989 Thomas ..... 147/48

* cited by examiner

*Primary Examiner*—Ed Tolan
(74) *Attorney, Agent, or Firm*—Porter, Wright, Morris & Arthur LLP

(57) ABSTRACT

Each of two end sections and one middle section of the present basket form is formed with a centrally and axially disposed passageway and with a pair of diametrically opposing passageways spaced radially outwardly from the central passageway. All of the passageways in one of the sections are simultaneously alignable with corresponding passageways in the other sections. The central passageways are adapted to receive a mounting member. Each of the radially outwardly disposed passageways are adapted to receive a bolt, and a wing nut is tightened onto an outwardly projecting threaded end of each bolt to hold the separable sections of the form in alignment with one another. The middle section of the form may be removed and the two end sections held in alignment with one another to accommodate a shallower basket.

15 Claims, 3 Drawing Sheets

SEGMENTED VARIABLE HEIGHT BASKET BODY FORM

RELATED APPLICATION

The priority of U.S. application Ser. No. 60/094,981 filed Jul. 31, 1998 in the names of the above-identified inventors is claimed for the present application.

BACKGROUND OF THE INVENTION

The present invention relates to basket making apparatus and more particularly to a form which facilitates construction of the walls and upper portions, or body, of a hand woven basket.

Typically, there are at least two principal stages or stations in manufacturing a basket by hand. In the first stage, the operator constructs the basket bottom, and in the second stage, the body, i.e., the walls and upper portions, of the basket are constructed. A bottom form, such as that disclosed in applicants' U.S. patent application Ser. No. 09/126,822, filed Jul. 31, 1998 and titled "Apparatus and Method for Forming a Basket Bottom," may be used to advantage in the first step. The bottom which is formed thereby includes a plurality of splints extending laterally outwardly from the bottom in various directions controlled in principal part by the bottom form. In the second stage, and as more fully described herein, the laterally extending splints are bent or otherwise turned to define the generally vertically extending upsplints of the basket walls. A basket body form is employed in the second stage to assist the operator in shaping the upsplints, in weaving the generally horizontally disposed cross splints therebetween, and in affixing a rim, reinforcing members, handle and/or other accessories to the upper open end of the basket wall or body. In this second stage, the basket bottom is sandwiched and clamped between one end of the body form and a generally disc shaped member known as a screw-down by means of a variable position standing vise or other support which suspends the assembly at a suitable height and orientation for the operator to manipulate the upsplints, cross splints and other basket members.

In the past, the basket body forms with which the present inventors are familiar were of unitary construction and nonadjustable. While such forms were very useful, each was limited to use in making one particular shape and size of basket. As may be appreciated, commercial advantage is derived from having many shapes and sizes of baskets to offer, and further advantage obtains from periodic creation and implementation of new basket designs. Given the foregoing limitation of nonadjustable and unitary basket body forms and the need for a large and periodically expanding array of basket models, the present inventors were faced with substantial equipment inventory problems, namely, constructing, maintaining, storing, locating, distributing and generally accounting for a multiplicity of basket body forms.

SUMMARY OF THE INVENTION

The form described herein for use in constructing a basket basically comprises a plurality of separate sections, each section having at least two spaced apart passageways, each of the passageways in one section having corresponding passageways in the other sections and all of the passageways in one section being simultaneously alignable with the corresponding passageways in the other sections.

DETAILED DESCRIPTION OF THE PREFERRED EMBODIMENT

Figure 1:
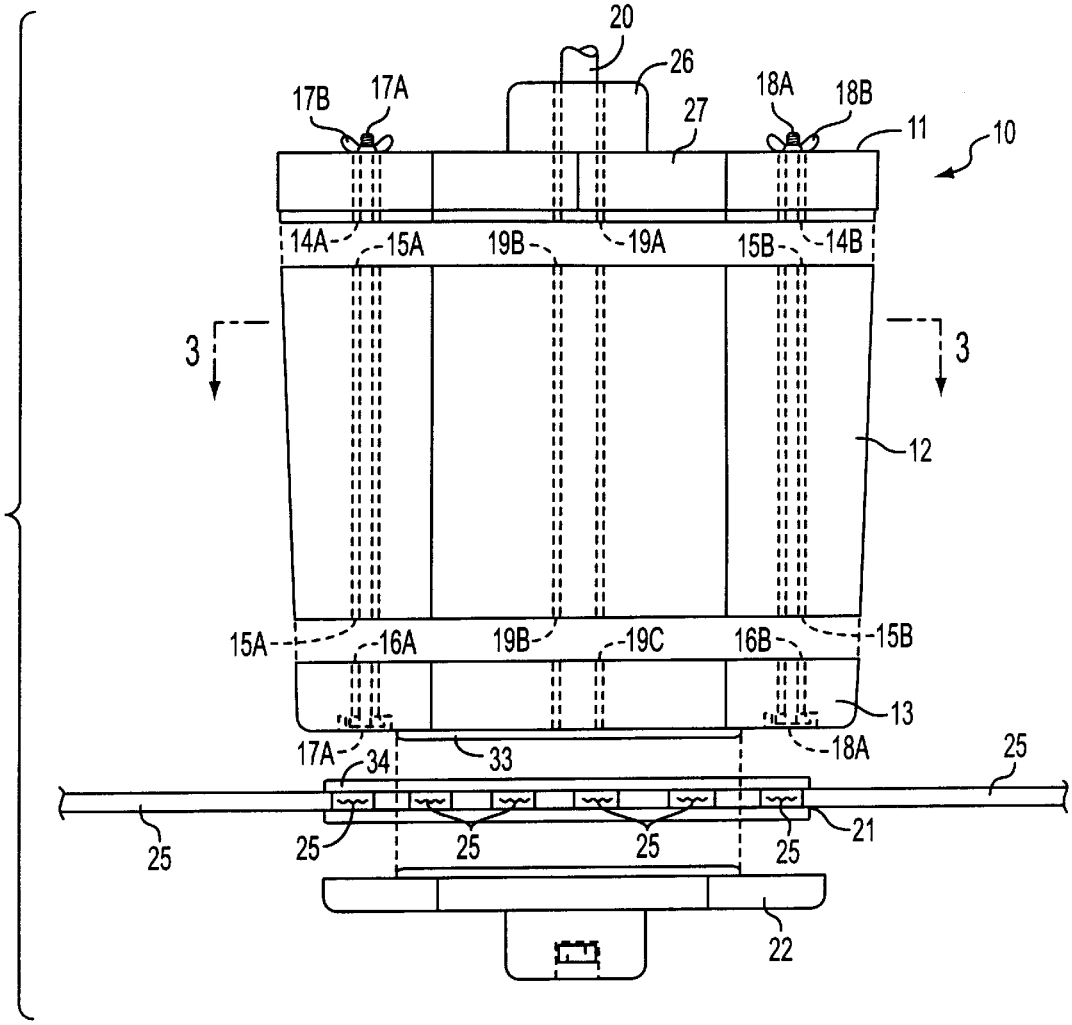
FIG. 1 is an exploded elevational view of the basket form described herein, together with a basket bottom and a screw down member.

As illustrated in FIG. 1, the present form, generally designated 10, is adapted for use in constructing the side walls and upper portions, collectively the body, of a hand woven basket. The subject basket form 10 comprises three separate sections or segments 11, 12, 13 and indexing passageways 14A–B, 15A–B, 16A–B for properly aligning the segments relative to one another. Fastener assemblies 17, 18 releasably hold the segments together.

A centrally and axially disposed bore or passageway 19A–C is formed in each of the segments 11–13 for receiving a mounting member 20 on a standing vise or other support structure (not shown). As illustrated in FIG. 1, each of the indexing passageways and central passageway in one section has corresponding passageways in the other sections, and all of the passageways in one section are simultaneously alignable with the corresponding passageways in the other sections.

Although illustrated in exploded fashion, the three sections 11–13 are adapted to be disposed in close fitting relation with one another and are provided with substantially planar abutting surfaces for this purpose. The subject basket form 10 is adapted to be mounted on the standing vise with the lower section 13 of the form 10 disposed in abutting relation with an inner central portion of a basket bottom 21. A screw down member 22 is adapted to be mounted on an opposite end of the standing vise in abutting relation with an outer central portion of the basket bottom 21. When the standing vise is then tightened, the basket bottom 21 is held tightly against the lower section 13 of the present body form 10. Splints 25 projecting laterally outwardly from the basket bottom 21 are then bent or otherwise turned to define upsplints which generally conform to the outer surface of the present body form 10, crossplints (not shown) are woven between the upsplints in a selected pattern, and a rim and other accessories (not shown) are attached in the usual manner.

Figure 2:
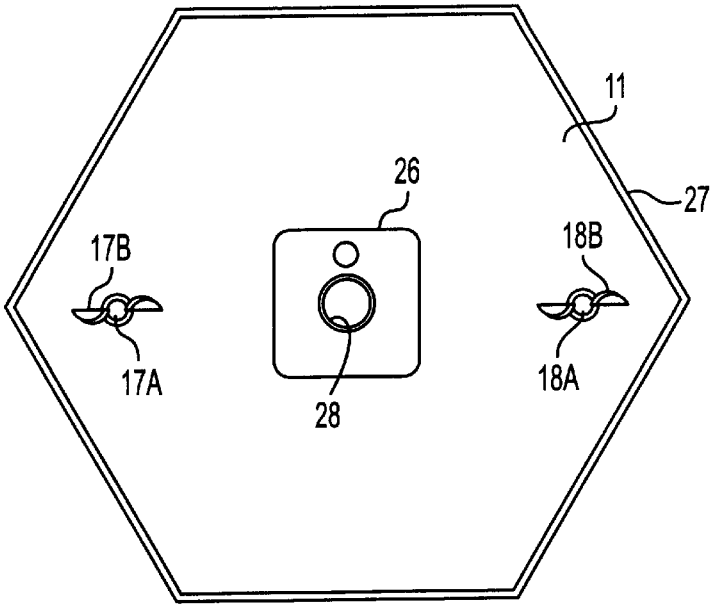
FIG. 2 is a top view of one end section of the present form.

As illustrated in FIGS. 1 and 2, the upper section 11 is provided with an upwardly projecting mounting spacer 26 and with a circumferential metal band 27. The mounting spacer 26 provides a gap between the upper portion and the standing vice to facilitate construction of the upper portions of the basket body. The metal band 27 provides a durable surface against which tacks or other fasteners may be driven through a rim or other reinforcing member (not shown) provided on the upper open end of the basket.

Figure 3:
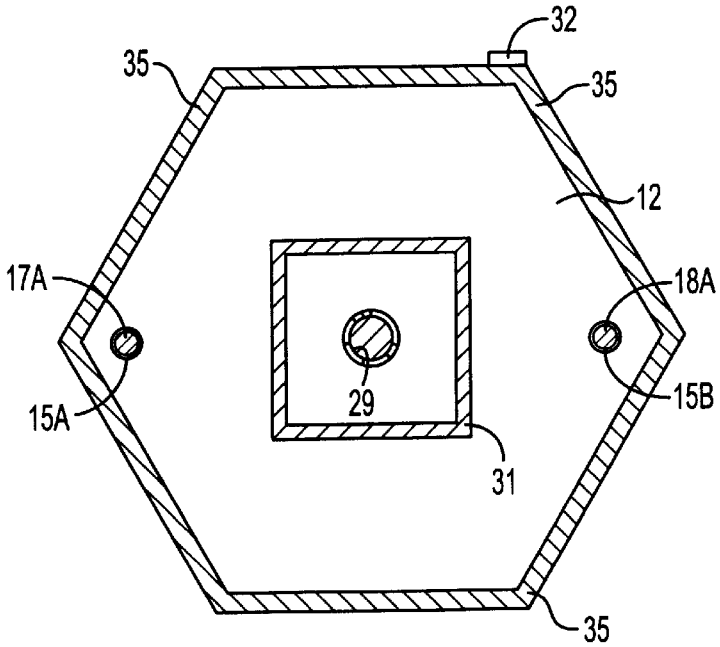
FIG. 3 is a sectional view taken along line 3—3 of FIG. 1 and particularly illustrates a middle section of the present form.
Figure 4:
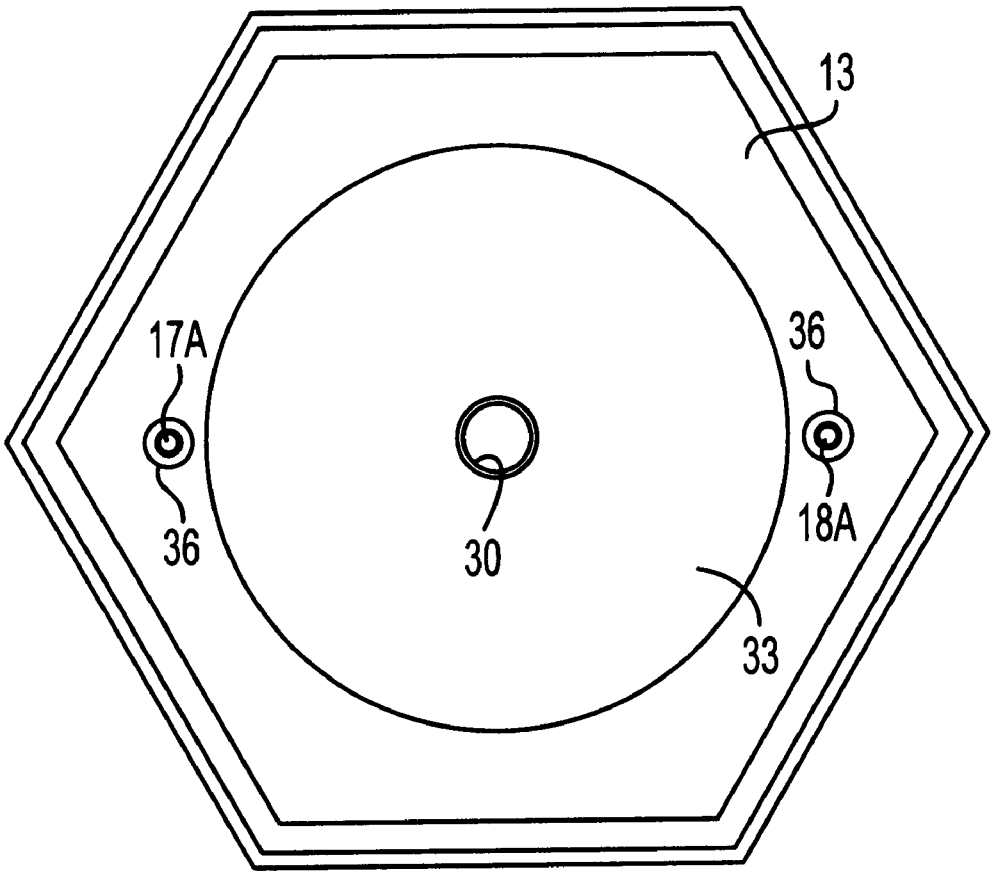
FIG. 4 is a bottom view of an opposite end section of the form.

As illustrated in FIGS. 2–4, tubular sleeves 28, 29, 30 are preferably force fitted or otherwise secured in the central bores 19A–C of the upper, middle and lower sections 11–13, respectively. In this manner, the shaft or mounting member 20 is less likely to enlarge or otherwise damage the central bores, and proper alignment of the present body form 10 on the standing vise is maintained over a longer period of use.

As illustrated in FIGS. 1–4, the indexing passageways 14A–B, 15A–B, 16A–B are preferably diametrically opposed to one another and are disposed on opposite sides of the central passageways 19A–C in each of the middle and end sections 11–13. The fastener assemblies 17, 18 preferably comprise a pair of elongated members, such as bolts 17A, 18A and a pair of locking members, such as wing nuts 17B, 18B. The bolts 17A, 18A are sized to extend through the indexing passageways in all of the sections and to project outwardly from the upper end section 11. The wing nuts 17B, 18B are mounted on threaded portions of the bolts 17A, 18A extending beyond the form's upper end section 11.

The upper, middle and lower sections 11–13 must be securely fastened together during use so that the sections do not twist relative to one another in response to stresses placed on the respective segments during construction of the basket body, particularly when the basket body has a non-circular cross section. Supplemental fasteners, including flush-mounted wood screws, clips, latches, and the like (not shown in the drawings) may be provided to further secure the end sections 11, 13 to the middle section 12.

As illustrated in FIGS. 1 and 3, the middle section 12 of the present body form 10 is substantially larger in an axial direction than the upper 11 and lower 13 end sections. In order to reduce the weight of the middle section, it may be hollow form in construction, with a central pillar or column 31 extending between upper and lower plates thereof in spaced relation to the outer walls 35 of the section. Advantageously, the middle section 12 is not subjected to the same degree of inwardly directed forces as the upper 11 and lower 13 end sections are during basket construction. In addition, the middle section 12, and the other sections, for that matter, may be provided with one or more tabs or spines 32 on one or more of the outer walls 35 to assist in indexing the sections, locating the cross splints or otherwise assisting the operator in constructing the basket walls.

As illustrated in FIGS. 1 and 4, the lower end section 13 is preferably provided with a downwardly projecting member, such as disc-shaped member 33, which is sized and shaped to nest within an opening in an upper reinforcing member, such as ring 34, on the basket bottom 21. In this manner, the basket bottom is less likely to shift position relative to the present basket body form 10 during basket construction. In addition, the passageways 16A, 16B in the lower end section 13 are preferably provided with countersunk regions 36 adjacent to the bottom of this section so that the heads of the bolts 17A, 18A may be recessed and thereby avoid interference with the nesting fit between the bottom disc 33 and the reinforcing ring 34 on the basket bottom 21.

The present basket form 10 is adapted for use in facilitating the manufacture of baskets having the same cross sectional shape and the same horizontal dimensions, but different heights. To adjust the present form 10 for making a shorter basket, the operator simply removes the middle section 12 and fastens the upper 11 and lower 13 end sections together with suitably sized bolts 17, 18. To make a taller basket, all three sections 11–13 of the form 10 are fastened tightly together with longer bolts 17, 18 as illustrated in FIG. 1. In this manner, the equipment inventory problems described above in the background portion of this application are significantly reduced.

As illustrated, the present basket form 10 is shaped and sized to facilitate construction of a hexagonally shaped basket that is wider at its open upper end than at its bottom. The present invention, however, is not intended to be limited to any particular external configuration with respect to the shape and size of the basket to be formed thereby.

What is claimed is:

1. A form for use in constructing a basket, said form comprising:

at least two separable sections;

each of the sections having at least two spaced apart passageways;

each of the passageways in any one of the sections having a corresponding passageway in each other section; and all of the passageways in any one of the sections being simultaneously alignable with the corresponding passageways in said each other section.

2. The form according to claim 1, wherein a first passageway in any one of the sections and a first corresponding passageway in said each other section are axially and centrally disposed in said sections.

3. The form according to claim 2, wherein second and third passageways in any one of the sections and second and third corresponding passageways in said each other section are disposed in radially outwardly spaced relation to the first passageway in said one of the sections and to the first corresponding passageway in said each other section, respectively.

4. The form according to claim 3, and further comprising two fastener assemblies, each of said fastener assemblies comprising an elongated member and a locking member, said elongated member being sized to extend through one of the second and third passageways in one section and through one of the second and third corresponding passageways in said each other section and to project outwardly from one of the sections, said locking member being mountable on a portion of the elongated member projecting outwardly from said one of the sections.

5. The form according to claim 4, wherein each of the second and third passageways is provided with a countersunk region adjacent to an outer surface of one of the separable sections for receiving one of the elongated members.

6. The form according to claim 2, wherein the axially and centrally disposed first passageway in one section and the axially and centrally disposed first corresponding passageways in said each other section are adapted to receive a mounting member.

7. The form according to claim 6, and further comprising separate tubular sleeves mounted in the axially and centrally disposed first passageway in one section and in each of the axially and centrally disposed first corresponding passageways in said each other section, said tubular sleeves being adapted to receive the mounting member.

8. The form according to claim 1, wherein said at least two separable sections comprise two end sections.

9. The form according to claim 8, wherein one of the end sections is provided with a mounting spacer projecting axially outwardly from an outer surface thereof.

10. The form according to claim 8, wherein one of the end sections is provided with a circumferential metal band.

11. The form according to claim 8, wherein one of the end sections is provided with an axially outwardly projecting disk for engaging a bottom portion of the basket.

12. The form according to claim 8, wherein said at least two separable sections further comprise a middle section.

13. The form according to claim 12, wherein each of the end sections is provided with a planar, middle-section-engaging surface.

14. The form according to claim 12, wherein the axial length of the middle section is greater than the axial length of either of the end sections.

15. The form according to claim 12, wherein the middle section is provided with an axially extending central support column spaced inwardly from at least one outer wall.

* * * * *